United States Patent [19]

Cherouge

[11] 4,270,162

[45] May 26, 1981

[54] BEACON LAMP

[75] Inventor: Dominique Chérouge, Le Vaudreuil Ville Nonvelle, France

[73] Assignee: Compagnie Industrielle des Piles Electriques "Cipel", Levallois-Perret, France

[21] Appl. No.: 30,052

[22] Filed: Apr. 13, 1979

[30] Foreign Application Priority Data

Apr. 24, 1978 [FR] France ..... 78 12031

[51] Int. Cl.[3] ..... F21V 5/04

[52] U.S. Cl. ..... 362/311; 362/333

[58] Field of Search ..... 362/26, 31, 62, 268, 362/307, 308, 309, 311, 326, 330, 331, 332, 333, 334, 335, 336, 337, 338, 339, 340

[56] References Cited

U.S. PATENT DOCUMENTS

| | | | |
|---|---|---|---|
| 1,945,190 | 1/1934 | Handlan | 362/309 |
| 2,021,611 | 11/1935 | Rolph | 362/309 |
| 2,352,801 | 7/1944 | Rolph | 362/309 |

FOREIGN PATENT DOCUMENTS

| | | | |
|---|---|---|---|
| 698128 | 10/1953 | United Kingdom | 362/337 |

*Primary Examiner*—Joseph W. Hartary
*Assistant Examiner*—Alan Mathews
*Attorney, Agent, or Firm*—Kenyon & Kenyon

[57] ABSTRACT

The invention relates to a beacon lamp which includes a point source of light located at F and surrounded by a transparent cap (20) which is in the shape of a solid of revolution about an axis zz' which passes through F and which forms at least one annular lens (L1, L2) whose focus is F. The profiles of the optical surfaces of the lens(es) are such that they produce a cap which can easily be moulded and which is anastigmatic for the point F and infinity, i.e. which concentrates much of the light from the point F into a plane (25) through the point F. Application to lamps for indicating the survivors at sea of shipwrecks or air crashes, said lamp being suitable for equipping life jackets on board aircraft.

5 Claims, 3 Drawing Figures

BEACON LAMP

The invention relates to beacon lamps, such as lamps for indicating survivors at sea of a shipwreck or air crash; said lamps may equip life jackets on board aircraft.

A known lamp of this type includes a substantially point light source located at a point F and surrounded by a cap made of a transparent plastics material which forms at least one annular lens about an axis zz' which passes through the point F. Such a lens is plane on the inside, being delimited by a cylindrical surface whose axis is zz', and convex on the outside, being delimited by a surface of revolution about the axis zz' and whose generatrix is a portion of a circle. The focus of the lens is at F. In other words, it concentrates much of the light emitted by the source into a plane perpendicular to the axis zz', which plane is normally horizontal when the survivor floats in the sea and should help spotting from nearby boats.

Known lamps have disadvantages, in particular because the above-defined lens is difficult to mould; indeed, the shape of its outer convex surface entails the use of a two part mould with a flash line which must lie in the said plane perpendicular to zz' passing through F. It is observed that much of the light diverges from the theoretical light plane and that this reduces the distance at which a given lamp is visible.

Preferred embodiments of the present invention produce a beacon lamp with improved optical qualities which is easier to manufacture than prior lamps.

The present invention provides a beacon lamp including a substantially point source of light located at a point F inside a transparent cap, the cap including an annular lens disposed around an axis zz' passing through the point F to concentrate light from the light source into a plane perpendicular to the axis zz' and passing through the point F, the cap having a closed end on one side of said plane and an open end on the other side of said plane, and wherein the annular lens comprises two zones (L1, L2) located, respectively, on said one and said other sides of the plane, the inside surfaces and outside surfaces of the zones being defined in terms of their cross-sectional profiles in a plane including the axis zz' as follows:

the inside surface of the first zone has a cross-section which is rectilinear or curved to be concave towards the axis zz';

the inside surface of the second zone has a cross-section which is curved to be convex towards the axis zz';

the outside surface of the first zone has a cross-section which is curved to be convex away from the axis zz'; and the outside surface of the second zone has a cross-section which is rectilinear or curved to be concave away from the axis zz';

the shape of the cap as a whole being such that it is capable of being moulded between a single inner portion and a single outer portion of a die, i.e. there are no re-entrant portions in either the inner or the outer surface of the cap, so that any straight line parallel to the axis zz' will intersect either surface no more than once.

Preferably the cap is a solid of revolution about the axis zz', in which case each said cross-section is a generatrix of a surface of revolution. Said cross-sections or generatrices are preferably chosen such that the lens is anastigmatic for the point F and infinity. By way of example the generatrices of the surface may have the following shapes:

the inside surface of the first zone has a circular generatrix;

the inside surface of the second zone has a hyperbolical generatrix;

the outside surface of the first zone has an elliptical generatrix; and the outside surface of the second zone has a rectilinear generatrix.

A prior art beacon lamp and an embodiment of the present invention are described with reference to the accompanying drawings, in which.

Figure 1:
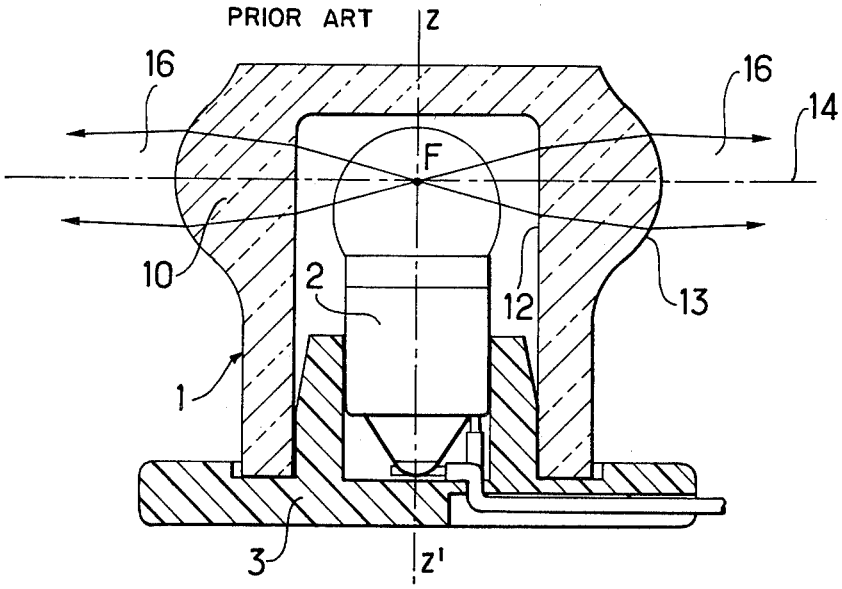
FIG.1 PRIOR ART
FIG. 1 illustrates schematically a cross-section of a beacon lamp in accordance with the prior art for locating survivors at sea.

The known lamp illustrated in FIG. 1 includes a cap 1 made of plastics material and a light bulb 2, both the cap 1 and the bulb 2 being fixed in a support 3. The assembly formed by the cap 1 and the light bulb 2 is symmetrical about an axis zz' which passes through a point F at which the filament of the light bulb 2 is located. The cap 1 has an upper zone which forms a lens 10 delimited internally by a cylindrical surface 12 and externally by a convex surface 13 having a generatrix which is an arc of a circle. The focus of the lens 10 is at F and the lens has a plane of symmetry which passes through the point F and which is perpendicular to the axis zz' and which is indicated in the plane of the figure by a line 14.

As stated above, such a cap is difficult to mould and its optical quality is poor which leads to a poorly formed beam of emerging rays 16.

Figure 2:
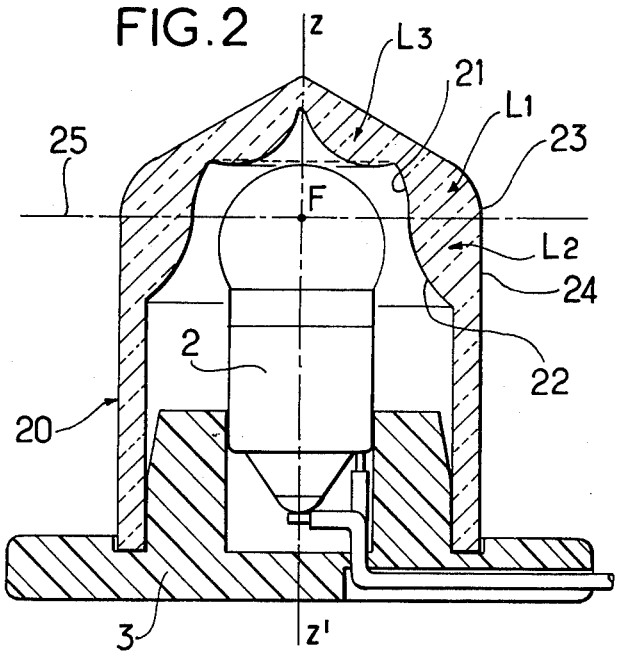
FIG. 2 illustrates schematically a cross-section of a beacon lamp in accordance with the invention for locating survivors at sea.

The lamp illustrated in FIG. 2 makes it possible to remedy these drawbacks by means of a cap 20 made of a transparent plastics material, in the form of a body of revolution about an axis zz', said cap containing the bulb 2 whose filament is located at a point F. A plane perpendicular to zz' and passing through F is referenced 25. It separates two half spaces the first of which contains the reference z and the second of which contains the reference z'.

Figure 3:
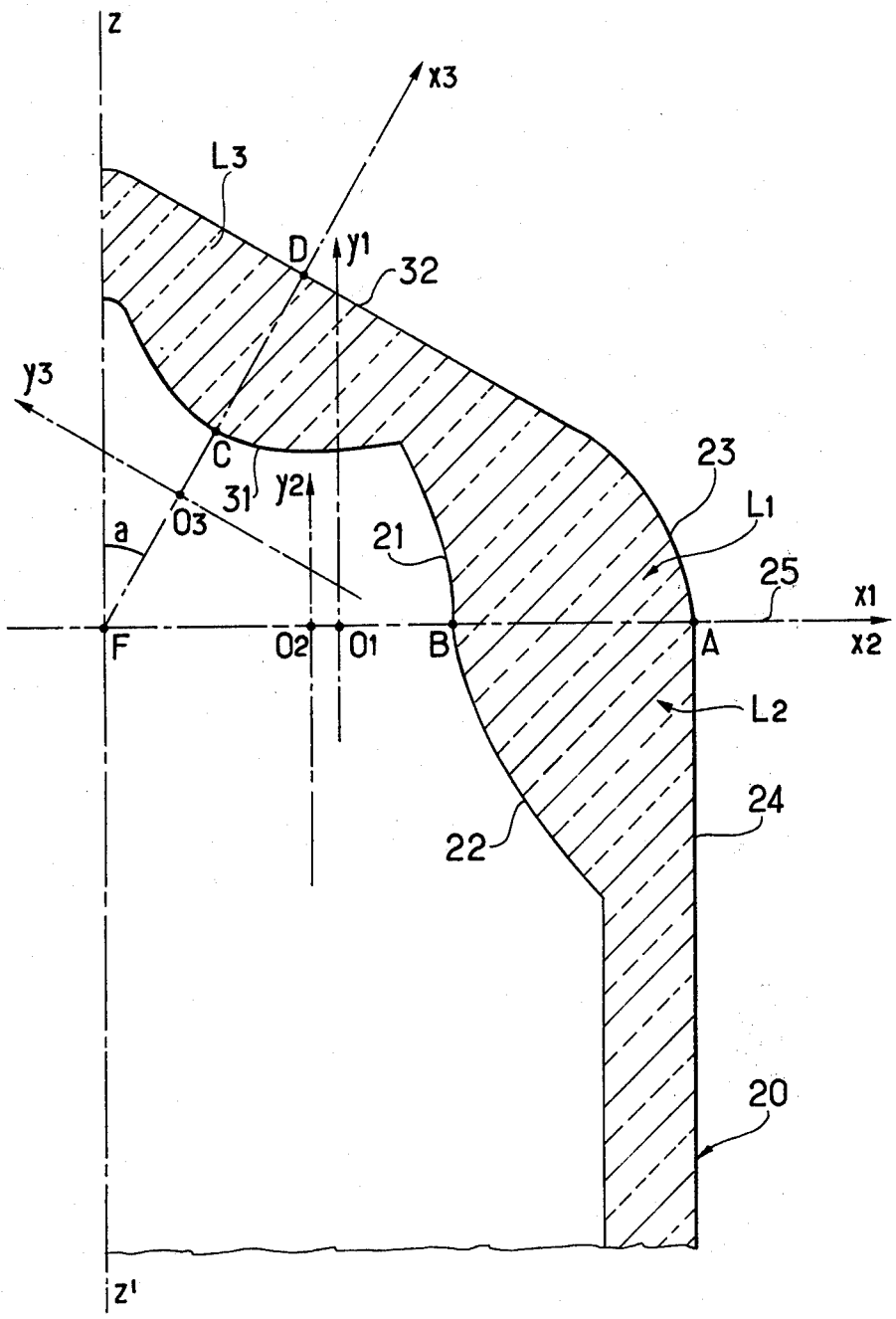
FIG. 3 illustrates a half cross-section on an enlarged scale of the lens of the lamp illustrated in FIG. 2.

The cap 20 includes an annular lens which has two zones L1 and L2 situated respectively in the first and second half spaces and illustrated in greater detail in FIG. 3.

In cross-section, as shown in FIGS. 2 and 3, the zone L1 of the lens has a concave inner surface 21 and a convex outer surface 23. Likewise the zone L2 has a convex inner surface 22 and an outer surface 24 of rectilinear section. Such a cap may be closed with a plane end wall as illustrated in FIG. 1, or with a third lens zone L3 whose use is described below. In either case, it is clear that the cap can be moulded without requiring a flash line running around the annular lens. This ease of moulding would still be possible if the concave inner surface 21 of the zone L1 were replaced by a surface of rectilinear section and/or if the outer surface 24 of the zone L2 were replaced by a concave surface.

Advantageously, so as to lose as little as possible of the light which emerges in the vicinity of the plane 25, the generatrices of the surfaces 21, 22, 23 and 24 are chosen so as to be anastigmatic between the point F and infinity, i.e. so as to produce an emerging beam which is parallel to the plane 25 in all directions about the axis zz'.

FIG. 3 illustrates, on an enlarged scale, a solution which provides anastigmatism in the lens zones L1 and L2.

Hereinafter, the following references will be used:

n for the refractive index of the material of which the cap 20 is made;

A and B for the points where the axis 25 intersects the outer and the inner surfaces respectively of the cap 20;

R for the distance FA; and r for the distance FB.

The values of n, R and r are fixed a priori.

The generatrix of the surface 23 is defined in a system of axes $O_1x_1$, $O_1y_1$, where $O_1x_1$ lies in the plane 25, and the point $O_1$ is such that $FO_1=R/(n+1)$. The generatrix of the surface 23 is a portion of an ellipse whose equation is:

$$\frac{x_1^2(n+1)^2}{R^2n^2}+\frac{y_1^2(n+1)}{R^2(n-1)}=1$$

Further, the generatrix of the surface 22 is defined in a system of axes $O_2x_2$, $O_2y_2$, where $O_2x_2$ lies in the plane 25, and the point $O_2$ is such that $FO_2=rn/(n+1)$. The generatrix of the surface 22 is a portion of a hyperbola whose equation is:

$$\frac{x_2^2(n+1)^2}{r^2}-\frac{y_2^2(n+1)}{r^2(n-1)}=1$$

The generatrix of the surface 21 lies on a portion of a circle whose centre is F and whose radius is r and the generatrix of the surface 24 is a portion of a straight line which passes through A and is perpendicular to the axis 25.

The lens zones L1 and L2 are therefore completely defined. The light which comes from F and strikes the zone L1 is not deviated by the optical surface 21; it leaves the optical surface 23 exactly parallel to the plane 25, since the latter surface is exactly anastigmatic for the point F and infinity. The light which comes from F and strikes the zone L2 emerges from the surface 22 parallel to the plane 25, since the latter surface is exactly anastigmatic for the point F and infinity; this light is travelling orthogonally to the outer surface 24 and is not deviated thereby.

It is observed that the thickness AB may be very much less than the thickness of the lens illustrated in FIG. 1. This results in a reduction in weight, which is important when a large number of such beacon lamps are to be loaded on board an aircraft, and further improves moulding conditions for the lamp.

Lastly, the cap illustrated in FIG. 3 includes an upper lens zone L3 which is a body of revolution about the axis zz' and is delimited by an inner optical surface 31 which is convex in section and by an outer optical surface 32 which is conical. The generatrix of the surface 31 is of the same type as the generatrix of the surface 22, and it is a hyperbola referenced in a system of axes $O_3x_3$, $O_3y_3$, where $O_3x_3$ forms an angle a with the axis 22' and intersects the lens zone L3 at two points C and D. The generatrix of the surface 32 is rectilinear and perpendicular to $O_3x_3$.

The lens zone L3 is anastigmatic for the point F and infinity and concentrates light striking the zone L3 from the point in the nappe or sheet of a cone whose apex is at F and whose half angle at the apex is equal to a. The conical surface in which the beam is concentrated is useful for aircraft spotting of survivors at sea.

Of course, the invention is not limited to the examples which have just been given. Without going beyond the scope of the invention, any component could be replaced by an equivalent component.

I claim:

1. A beacon lamp including substantially point source of light located at a point F and a transparent cap enclosing the light source, the cap including an annular lens disposed around an axis zz' passing through the point F, the lens being adapted to refract light from the light source to form a beam substantially parallel to and including a plane perpendicular to the axis zz' and passing through the point F, the cap having a closed end located on one side of said plane and an open end located on the other side of said plane, wherein the annular lens comprises a first zone ($L_1$) and a second zone ($L_2$) located on said one and said other sides, respectively, of the plane, said first and said second zones being contiguous, the inside surfaces and outside surfaces of the zones being defined in terms of their cross-sectional profiles in a plane including the axis zz', as follows:

the cross-sectional profile of the inside surface of the first zone is a line, the distance of which from the axis zz' decreases with increasing distance from said plane;

the cross-sectional profile of the inside surface of the second zone is a line curved to be convex towards the axis zz', and the distance of which from the axis zz' increases with increasing distance from said plane;

the cross-sectional profile of the outside surface of the first zone is a line curved to be convex away from the axis zz'; and the cross-sectional profile of the outside surface of the second zone is a line, the distance of which from the axis zz' does not decrease with increasing distance from said plane, such that the cross-sectional profiles of said inner and outer surfaces have no reentrant portions, so that any line parallel to the axis zz' intersects either profile no more than once, whereby the cap is adapted to be molded between a single inner male die and a single outer female die.

2. A lamp according to claim 1, wherein the cross-sectional profiles are chosen such that the lens is anastigmatic for the point F and infinity.

3. A lamp according to claim 2, wherein the cross-sectional profiles of the lens surfaces have the following shapes:

the profile of the inside surface of the first zone is circular;

the profile of the inside surface of the second zone is hyperbolic;

the profile of the outside surface of the first zone is elliptic; and the profile of the outside surface of the second zone is rectilinear.

4. A beacon lamp according to claim 1, 2, or 3, wherein the cap is a body of revolution about the axis zz' such that each of said cross-sectional profiles of an optical surface is a generatrix of a surface of revolution.

5. A beacon lamp according to claim 1, 2, or 3 wherein substantially all deviation of a light ray from the point F passing through the first zone of the lens occurs at the outer surface of the first zone, and substantially all deviation of a light ray passing through the second zone of the lens occurs at the inner surface of the second zone.

* * * * *